United States Patent [19]

Busse et al.

[11] 4,300,626

[45] Nov. 17, 1981

[54] HEAT-PIPE THERMOSTATS OF HIGH PRECISION

[75] Inventors: Claus-Adolf Busse, Arolo di Leggiuno; Jean-Paul Labrande, Ispra, both of Italy

[73] Assignee: European Atomic Energy Community (EURATOM), Kirchberg, Luxembourg

[21] Appl. No.: 876,491

[22] Filed: Feb. 9, 1978

Related U.S. Application Data

[63] Continuation of Ser. No. 673,874, Apr. 4, 1976, abandoned.

[30] Foreign Application Priority Data

Apr. 4, 1975 [LI] Liechtenstein ..... 72213

[51] Int. Cl.[3] ..... F28D 15/00

[52] U.S. Cl. ..... 165/96; 165/104.26

[58] Field of Search ..... 165/32, 96, 105; 219/210, 399, 401; 73/15 R

[56] References Cited

U.S. PATENT DOCUMENTS

| | | | |
|---|---|---|---|
| 2,856,160 | 10/1958 | Kaye et al. | 165/105 X |
| 2,885,309 | 5/1959 | Brunbe | 165/105 X |
| 3,585,842 | 6/1971 | Roof | 165/105 X |
| 3,965,334 | 6/1976 | Asselman et al. | 165/105 X |

*Primary Examiner*—Albert W. Davis

*Attorney, Agent, or Firm*—Stevens, Davis, Miller & Mosher

[57] ABSTRACT

In a gas-controlled heat-pipe thermostat of high precision having a temperature-controlled chamber arranged at least partly within the evaporation and condensation cycle and a gas reservoir connected to said heat-pipe, the improvement comprising in that in the heat-pipe a cooling surface is arranged for the production of condensate which, for the scavenging of the surface of said temperature-controlled chamber in a directed manner, is connected to the outer wall of said chamber by liquid conducting capillary structures.

1 Claim, 2 Drawing Figures

HEAT-PIPE THERMOSTATS OF HIGH PRECISION

Figure 1:
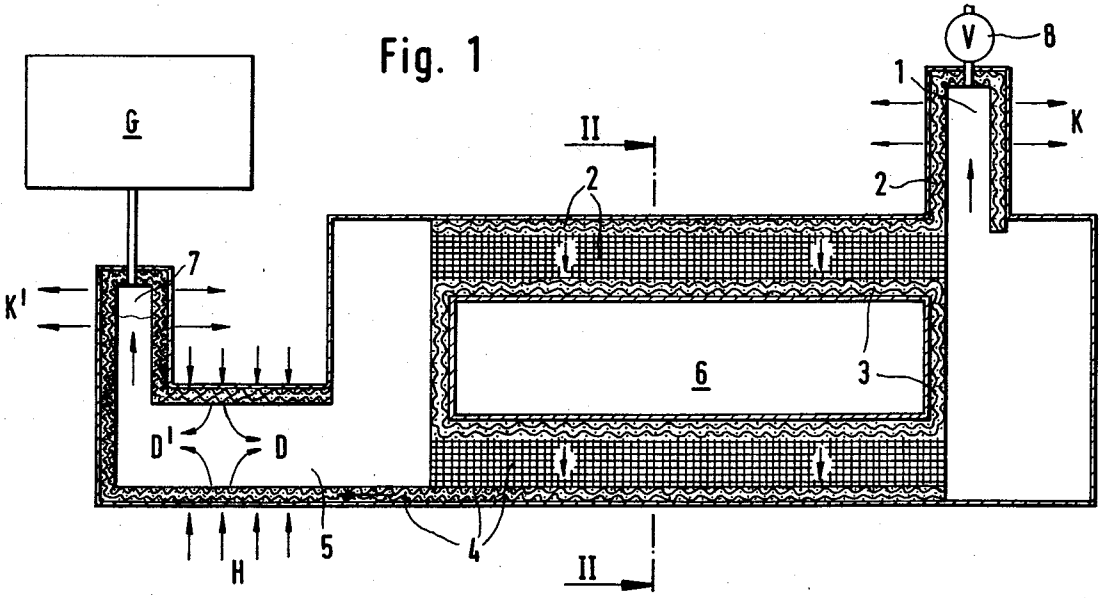

This is a continuation of application Ser. No. 673,874, filed Apr. 4, 1976, now abandoned.

The invention concerns gas-controlled heat chambers, also known as heat-pipe thermostats, as described in the Luxemburg Pat. No. 70419. In particular, the invention concerns heat chambers in which the desired temperature can be set and maintained with a high degree of precision.

As is known, in gas-controlled heat pipes there is a relation, in the ideal case, between the pressure of the control gas and the temperature of the heat chamber which is determined by the vapor pressure curve of the working fluid used.

In practice, however, there are deviations from the ideal behavior which are very troublesome in heat-pipe thermostats of high accuracy.

The research work forming the basis of the present invention has shown that deviations are often due to the presence of endogenic impurities in the working fluid on the walls of the temperature-controlled chamber.

The impurities can be substances, for instance, which are detached from the walls of the chamber by the working fluid. Impurities of this kind in the working fluid reduce its vapor pressure at the temperature set. At a pre-determined control gas pressure, the detached impurities therefore cause a rise in the saturation temperature of the vapor and thus in the temperature of the heat chamber and this effect is in proportion to the magnitude of the concentration of detached impurities at the fluid/vapor phase boundary.

It should be mentioned that this effect in practice is only caused by impurities of low volatility since highly volatile impurities are diffused into the vapor phase at the fluid/vapor phase boundary so that their concentration at the surface of the fluid may be regarded as practically zero.

Since the contamination effect described is dependent on the constructional details of the heat chamber and its condition and can scarcely be defined or anticipated according to natural laws, the resultant reduction in temperature must be regarded in general as an uncertain factor in the absolute temperature level of the chamber and its maintenance over a period of time.

The invention is concerned with the problem of how this temperature error factor, i.e., the presence of impurities of low volatility in the fluid on the walls of the chamber, can be kept small.

The invention is based on the following considerations: high concentrations of impurities occur especially when fluid stagnates on the walls of the chamber since then there is much time available for the diffusion of impurities from the walls of the chamber into the fluid and thus the concentration of impurities in the fluid can rise to an equilibrium level or when there are zones of convergent streams of fluid on the walls of the chamber (i.e., vaporizing zones into which fluid streams from all sides) since impurities of low volatility entrained by the streams of fluid accumulate in such zones and in this manner their concentration can rise to the solubility limit. Such vaporizing zones on the walls of the chamber can occur when heat is passed to the walls of the chamber, either through exothermic processes in the interior of the chamber or from outside, e.g., through superheated steam striking the wall of the chamber or through the radiation of heat from very hot surfaces, e.g. from the actual heating zone of the heat pipes.

The invention is also based on the consideration that condensate freshly formed in the cooling zone is particularly clean since impurities of low volatility are hardly present in vapor and therefore not in the condensate resulting from this vapor either time is necessary for impurities to be detached or dissolved out of the walls.

In general, fresh condensate contains only volatile impurities, especially control gas, which are of no importance for the effect discussed here of the fall in vapor pressure through dissolved impurities as mentioned above.

On the basis of these considerations, the invention concerns a gas-controlled heat-pipe thermostat of high precision with a temperature-controlled chamber arranged at least partially within the vaporization and condensation cycles, characterized in that, in the heat pipe, a cooling surface for the production of condensate is arranged which, for the scavenging of the surface in a directed manner, is connected to the outer wall of the temperature-controlled chamber in such a way that liquid can be conducted to it.

Thus by this arrangement a high concentration of impurities on the surface of the fluid on the wall of the chamber is prevented since the wall of the chamber is constantly scavenged by a directed stream of fresh condensate. Through this stream the time for which each individual volume of fluid remains on the wall of the chamber is kept short and thus the concentration of impurities dissolved out of the wall in this time remains small. In the vaporizing areas, this stream is superimposed on the convergent stream with the result that fluid no longer flows into the vaporizing zone from all directions all the time but that now fluid flows in from one side and flows out the other (somewhat less, according to evaporation) and in this way the accumulation of impurities of low volatility is avoided.

There are many possibilities for the practical execution of the invention. Fumdamentally, the following is necessary:

a cooled surface which in the extreme case can also be a part of the chamber itself on which the condensate is produced a suitable 'connection' which enables the condensate to pass from the condenser to the surface of the chamber (insofar that the surface of the chamber is not itself the condenser)

a means to distribute the condensate over the surface of the chamber and finally a suitable 'connection' enabling the condensate to pass from the wall of the chamber to an evaporator.

Figure 2:
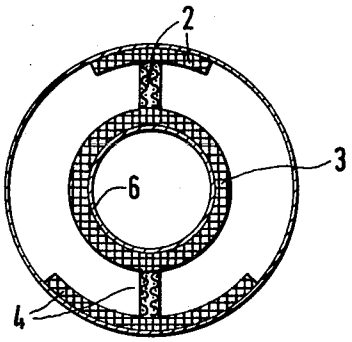

The invention is explained in more detail below with the aid of drawings. There is shown in:

FIG. 1 a longitudinal section through a heat-pipe thermostat in accordance with the invention FIG. 2 a section from II—II of FIG. 1.

As shown in FIG. 1, heat is passed to the heat pipe at H to evaporate the working fluid in the evaporation zone (5).

Part of the vapor (D') escapes to the cooling zone (K') which is connected to a gas pressure regulating system (G) via a gas buffer (7).

Other vapor (D) passes to the cooling zone (K) which can be connected via a cut-off valve (8) to a low-pressure chamber not shown here. Thus fresh condensate is formed at (1) and passes via the capillary structures (2) formed from several layers of fine-meshed wire netting at the top to the wall of the heat-chamber (6). The condensate is distributed there via a similar capillary and is ultimately passed back, at the bottom, via another capillary structure (4) to the evaporation zone (5).

The form of execution of the invention described is in no way restrictive. As is clear to those skilled in the art, the return of condensate to the wall of the chamber can be arranged instead of via capillary structures also by a distributing channel, for example, or by simply allowing it to drip down.

We claim:

1. In a gas controlled heat-pipe thermostat of high precision having a temperature-controlled chamber arranged at least partly within the evaporation and condensation cycle and a gas reservoir connected to said heat-pipe, the improvement comprising in that in the heat-pipe a cooling surface is arranged for the production of condensate and for contacting and scavenging the surface of said temperature-controlled chamber, said cooling surface being in a condensation zone outside the direct effect of the control gas and separate from the chamber and connected to the outer wall of said chamber by liquid conducting capillary structures.

* * * * *

UNITED STATES PATENT AND TRADEMARK OFFICE

CERTIFICATE OF CORRECTION

PATENT NO. : 4,300,626

DATED : November 17, 1981

INVENTOR(S) : BUSSE, et al.

It is certified that error appears in the above—identified patent and that said Letters Patent is hereby corrected as shown below:

On the title page of the patent under Foreign Application Priority Date, line 30, "Liechtenstein" should read -- Luxembourg --.

Signed and Sealed this

Ninth Day of March 1982

[SEAL]

*Attest:*

GERALD J. MOSSINGHOFF

*Attesting Officer*

*Commissioner of Patents and Trademarks*